US008277332B2

(12) United States Patent
Liu

(10) Patent No.: US 8,277,332 B2
(45) Date of Patent: Oct. 2, 2012

(54) GOLF BALL PICK-UP DEVICE

(76) Inventor: I-Chung Liu, Taipei (TW)

( * ) Notice: Subject to any disclaimer, the term of this patent is extended or adjusted under 35 U.S.C. 154(b) by 183 days.

(21) Appl. No.: 12/693,443

(22) Filed: Jan. 26, 2010

(65) Prior Publication Data

US 2011/0183774 A1 Jul. 28, 2011

(51) Int. Cl.
*A63B 47/02* (2006.01)

(52) U.S. Cl. ..... 473/286; 294/19.2

(58) Field of Classification Search ..... 473/286; 294/19.2

See application file for complete search history.

(56) References Cited

U.S. PATENT DOCUMENTS 2,489,958 A * 11/1949 Douglass ..... 294/19.2
2,524,527 A * 10/1950 Jasmer ..... 294/19.2
2,561,815 A * 7/1951 Oberg ..... 294/19.2
3,058,767 A * 10/1962 Baker ..... 294/19.2
3,210,111 A * 10/1965 Fallon ..... 294/19.2
3,749,407 A * 7/1973 Prochnow ..... 473/286
3,922,026 A * 11/1975 Schweitzer ..... 294/19.2
3,997,169 A * 12/1976 Bergstrom ..... 473/286
D361,354 S * 8/1995 Bailey et al. ..... D21/721
6,817,955 B2 * 11/2004 O'Donnell et al. ..... 473/284
7,850,539 B2 * 12/2010 Quinn ..... 473/286
2004/0067798 A1 * 4/2004 O'Donnell et al. ..... 473/286
2005/0170904 A1 * 8/2005 Smeeth ..... 473/286
2006/0058109 A1 * 3/2006 Wilson ..... 473/286
2009/0318241 A1 * 12/2009 Quinn ..... 473/286

* cited by examiner

*Primary Examiner* — Stephen L. Blau
(74) *Attorney, Agent, or Firm* — Leong C. Lei

(57) ABSTRACT

A golf ball pick-up device includes a body, which has a shape that allows the body to form a frame with a head of the golf club. The body has an end forming a clamping section that defines an internal receiving space. The clamping section also forms a sideway opening in communication with the receiving space. The clamping section uses the opening to lead a shaft of the golf club into the receiving space, so as to allow the clamping section to fit over and thus retain on the shaft of the golf club. A user may then use the frame formed by the body and the head of the golf club to pick up a golf ball, especially a ball that falls in a sand trap or a water hazard where hands may not reach to pick up the ball.

3 Claims, 10 Drawing Sheets

GOLF BALL PICK-UP DEVICE

TECHNICAL FIELD OF THE INVENTION

The present invention generally relates to a ball pick-up device, and more particularly to a golf ball pick-up device that is removably attached to a regular golf club to allow a user to directly use the golf club to pick up a golf ball and that is advantageous in respect of being easy to mount/dismount, being easy to carry, and low manufacturing cost.

DESCRIPTION OF THE PRIOR ART

With the prosperous development of commerce and industry, the income of people is quickly increased. Golf; which was considered a game that takes a great amount of money, is now getting very popular.

The golf game requires picking up balls very often. Thus, golf ball pick-up devices or tools are commonly available in the market. However, those known tools or devices have several drawbacks, which will be briefly discussed as follows.

(1) A known golf ball pick-up device is additionally attached to the grip of a golf club or integrally formed with a bottom of a head of a golf club. However, such a device is generally not removable from the golf club and is thus causing serious problem in the concern of outside appearance of the club. Further, it can be used to pick up golf balls falling on the green or where adjacent to the player and is incapable of picking up a ball falling in a sand trap or a water hazard.

(2) A known golf ball pick-up tool is not attached to a golf club and forms a stand-along tool, which comprises pick-up arm of a predetermined length and a tool body in order to reach out to a predetermined distant site for picking up a ball. However, since the tool has a long pick-up arm that occupies a great amount of space. Further, a golf player, when playing a game, needs to carry the tool in addition to the golf clubs. This causes inconvenience and also increases the manufacturing cost. Further, the tool body has a complicated structure, which further adds the manufacturing costs.

Thus, the known tools and devices made for picking up golf balls are in generally not good enough for practical use. The present invention aims to provide a golf ball pick-up device that overcomes the above discussed problems of the known tools and devices for picking up golf balls.

SUMMARY OF THE INVENTION

An object of the present invention is to provide a golf ball pick-up device that can be attached to a golf club to allow for direct use of the golf club to pick up a golf ball. Structurally, the golf ball pick-up device comprises a body, which has a shape that allows the body to form a frame with a head of the golf club. The body has an end forming a clamping section that defines an internal receiving space. The clamping section also forms a sideway opening in communication with the receiving space. The clamping section uses the opening to lead a shaft of the golf club into the receiving space, so as to allow the clamping section to fit over and thus retain on the shaft of the golf club. A user may then use the frame formed by the body and the head of the golf club to pick up a golf ball.

The clamping section has two opposing end edges that delimit the opening, each end edge forming a lead-in flange that provides a guiding-in function.

The body forms a brush having a function of sweeping.

The body forms a plurality of retention ribs that is engageable with a cap to retain the cap in a condition of enclosing the brush.

The clamping section is made of plastics to allow the opening to be resiliently expanded.

The body has a curved shape.

The clamping section has a C-shape.

The frame formed by the body and the head of the golf club has top and bottom openings, of which the top opening is wider than a diameter of a golf ball, while the bottom opening is narrower than the diameter of the golf ball in order to realize the function of picking up a golf ball.

The clamping section is mountable to a key ring and wherein the key ring comprises a retention seat having an I-shaped cross-section composed of a diameter-reduced central body and diameter-expanded top and bottom flanges, the clamping section being fit over and retained on the diameter-reduced central body by the diameter-expanded top and bottom flanges whereby the clamping section is securely retained on the key ring and is prevented from separation therefrom by the top and bottom flanges of the key ring.

The body forms a curvedly recessed section, and a slot is formed in the curvedly recessed section.

The g body has an end forming a fork.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
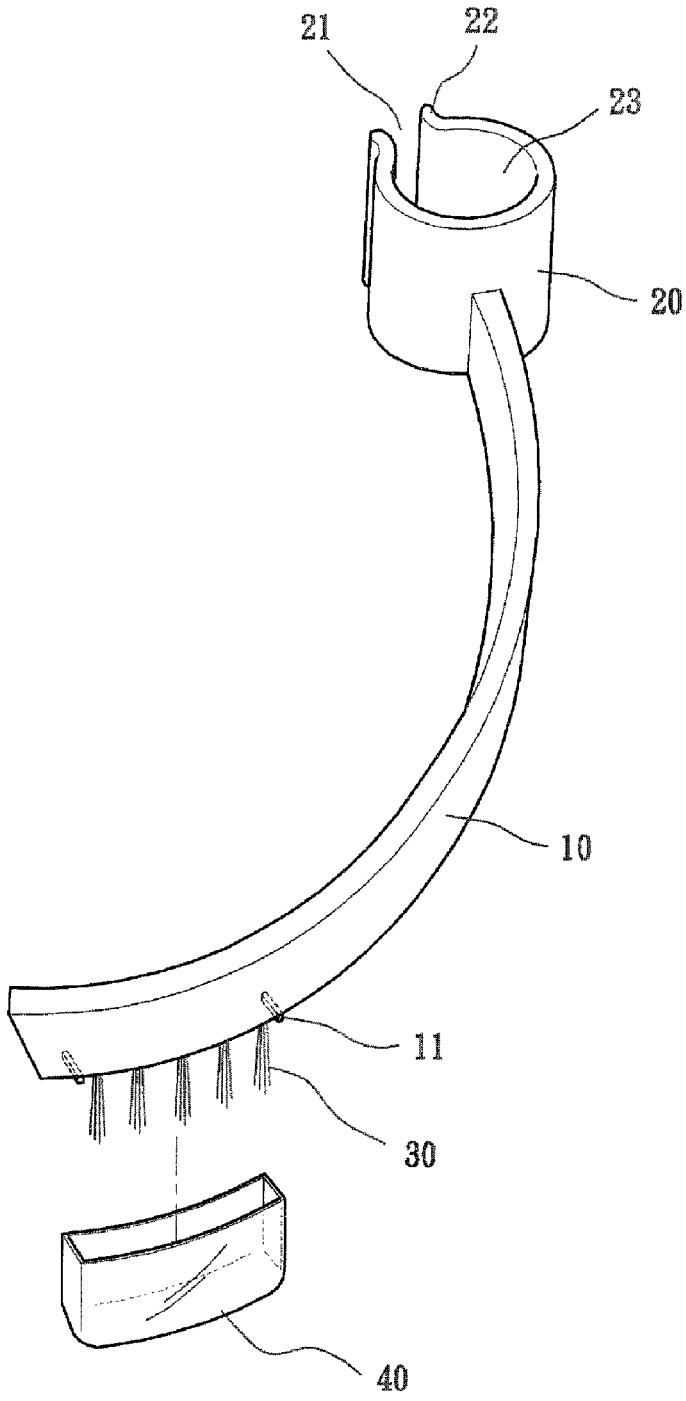
FIG. 1 is a perspective view of a golf ball pick-up device according to the present invention.

Referring to FIG. 1, a golf ball pick-up device according to a preferred embodiment of the present invention comprises a body 10, which has a shape that forms a frame in combination with a golf club head. (In the embodiment illustrated, the body 10 has a curved shape.) The body 10 has an end forming a C-shaped clamping section 20. The clamping section 20 forms a sideway opening 21. Preferably, the clamping section 20 is made of plastics, which provides resiliency that allows the opening 21 to be resiliently expanded. The opening 21 is delimited by two opposing end edges of the clamping section 20 and each end edge forms a lead-in flange 22, which provides a function of guiding in. The clamping section 20 also defines an internal receiving space 23 that communicates the opening 21. The body 10 has an opposite end that forms one or more brushes 30 that provide a function of wiping and sweeping. Two retention ribs 11 are provided on the body 10 at opposite sides of the brush 30 for engaging and retaining a cap 40. The cap 40 can be used to cover and enclose the brush 30 when the brush 30 is not in use, in order to improve aesthetics of the device.

Figure 2:
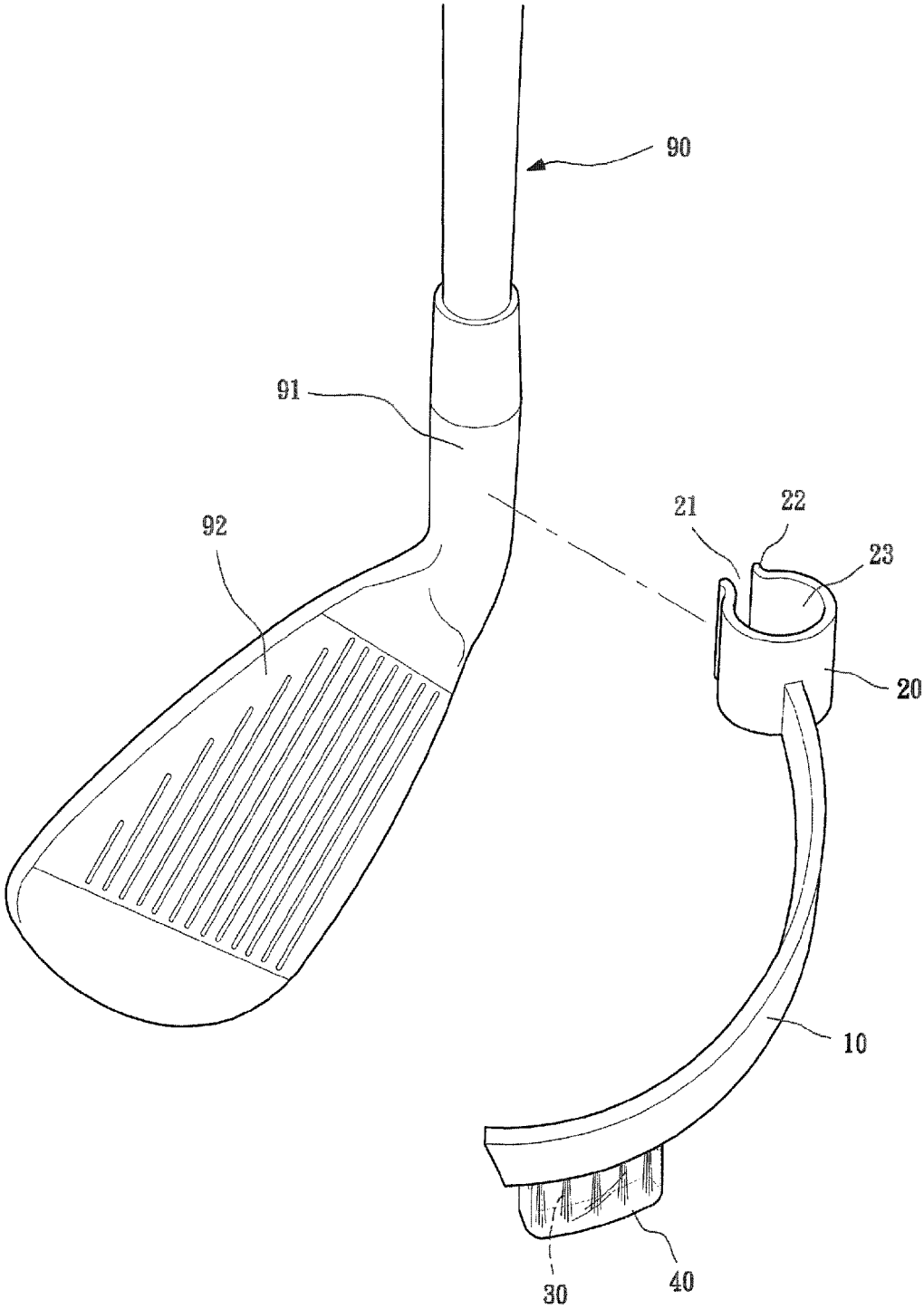
FIG. 2 is a perspective view illustrating a condition before the golf ball pick-up device is mounted to a head of a golf club.
Figure 3:
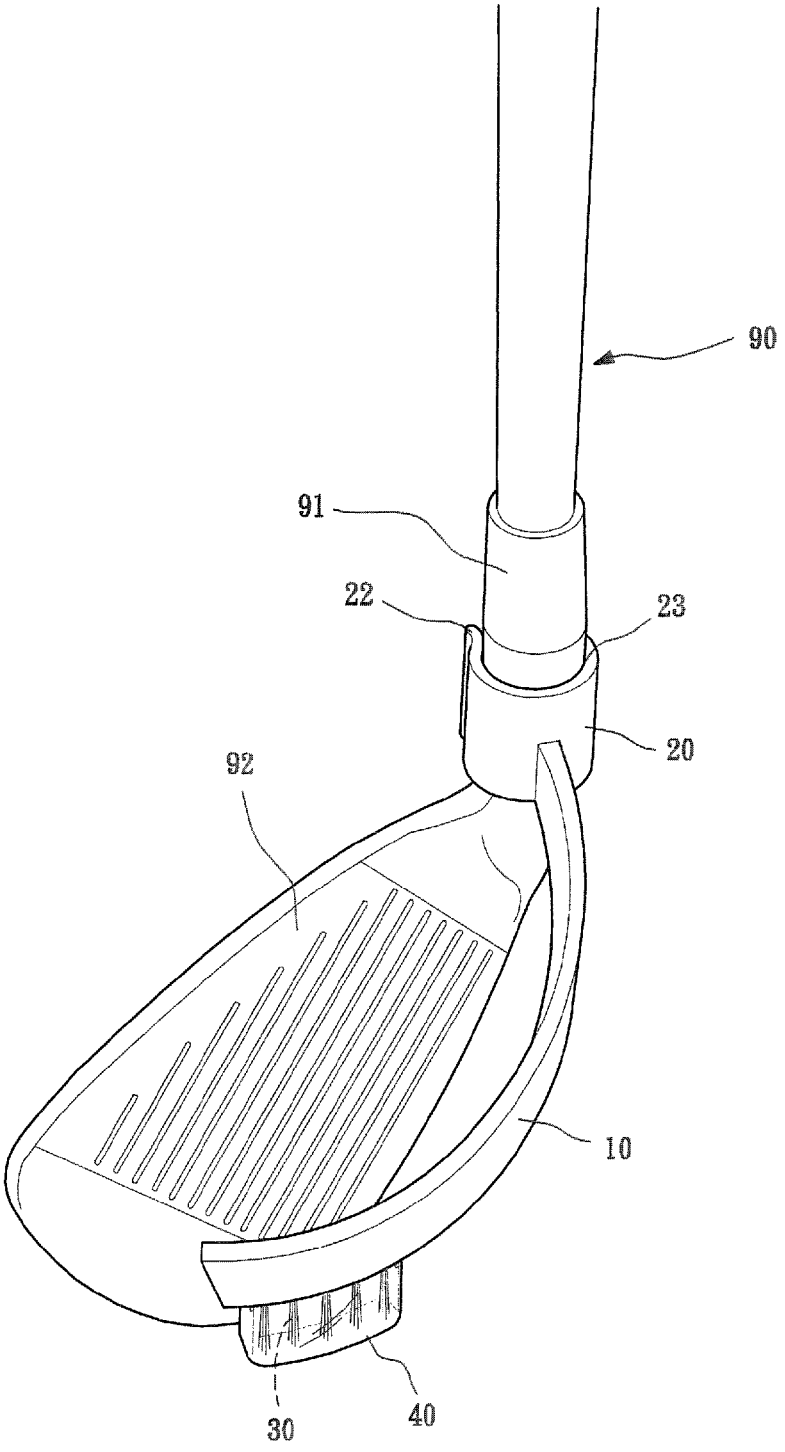
FIG. 3 is a perspective view illustrating a condition after the golf ball pick-up device is mounted to the head of the golf club.

Referring to FIGS. 2 and 3, the golf ball pick-up device of the present invention can be mounted to a golf club 90, wherein the shaft or neck 91 of the club 90 is forcibly positioned against the flanges 22 of the clamping section 20 for deforming the flanges 22 to thus resiliently expand the opening 21. The guiding function of the flanges 22 helps leading the shaft 91 into the receiving space 23 and thus the clamping section 20 is resiliently fit over the shaft 91. The opening 21 is made smaller than an outside diameter of the shaft 91 and due to the head 92 of the club 91 is located below the clamping section 20 to retain the clamping section 20 in position, the shaft 91 and the clamping section 20 are firmly held together and are prevented from undesired separation from each other. The resiliency of the clamping section 20 allows the golf ball pick-up device of the present invention and a golf club 90 to be readily mounted together or dismounted from each other without use of any tool. FIG. 3 shows that the body 10 and the head 92 of the golf club 90 together form a frame that having top and bottom openings, of which the top opening is wider than a diameter of a golf ball, while the bottom opening is narrower than the diameter of the golf ball. With this arrangement, pick-up of a golf ball can be effected. The golf ball pick-up device of the present invention can be removably mounted to a golf club 90 and a golf player does not need to carry a separate golf ball pick-up tool when he or she is playing a game. Thus, the present invention provides the advantages of being easy to carry and low manufacturing cost.

Figure 4:
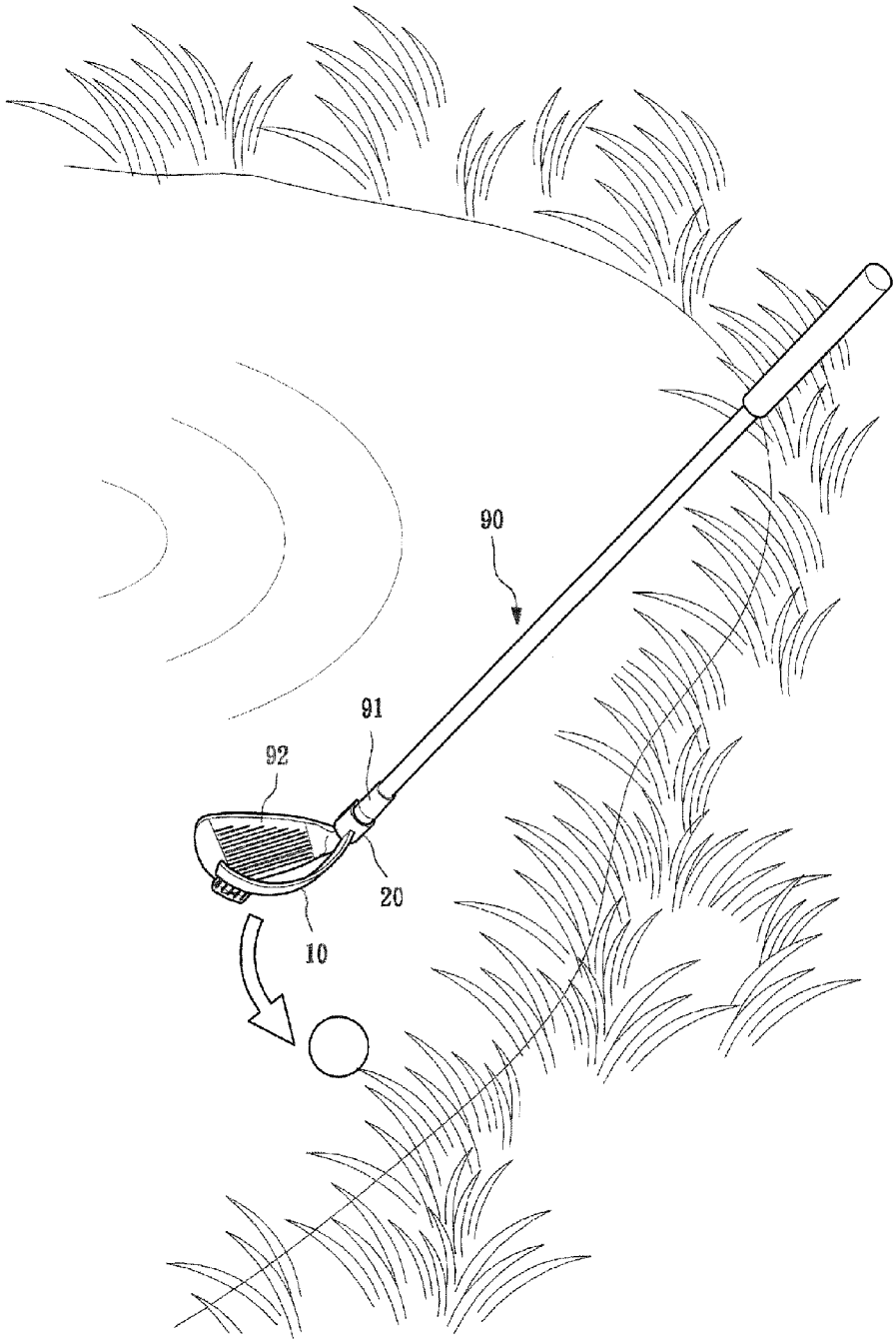
FIG. 4 is a schematic view illustrating the use of the golf ball pick-up device of the present invention in picking up a golf ball falling in a sand trap.
Figure 5:
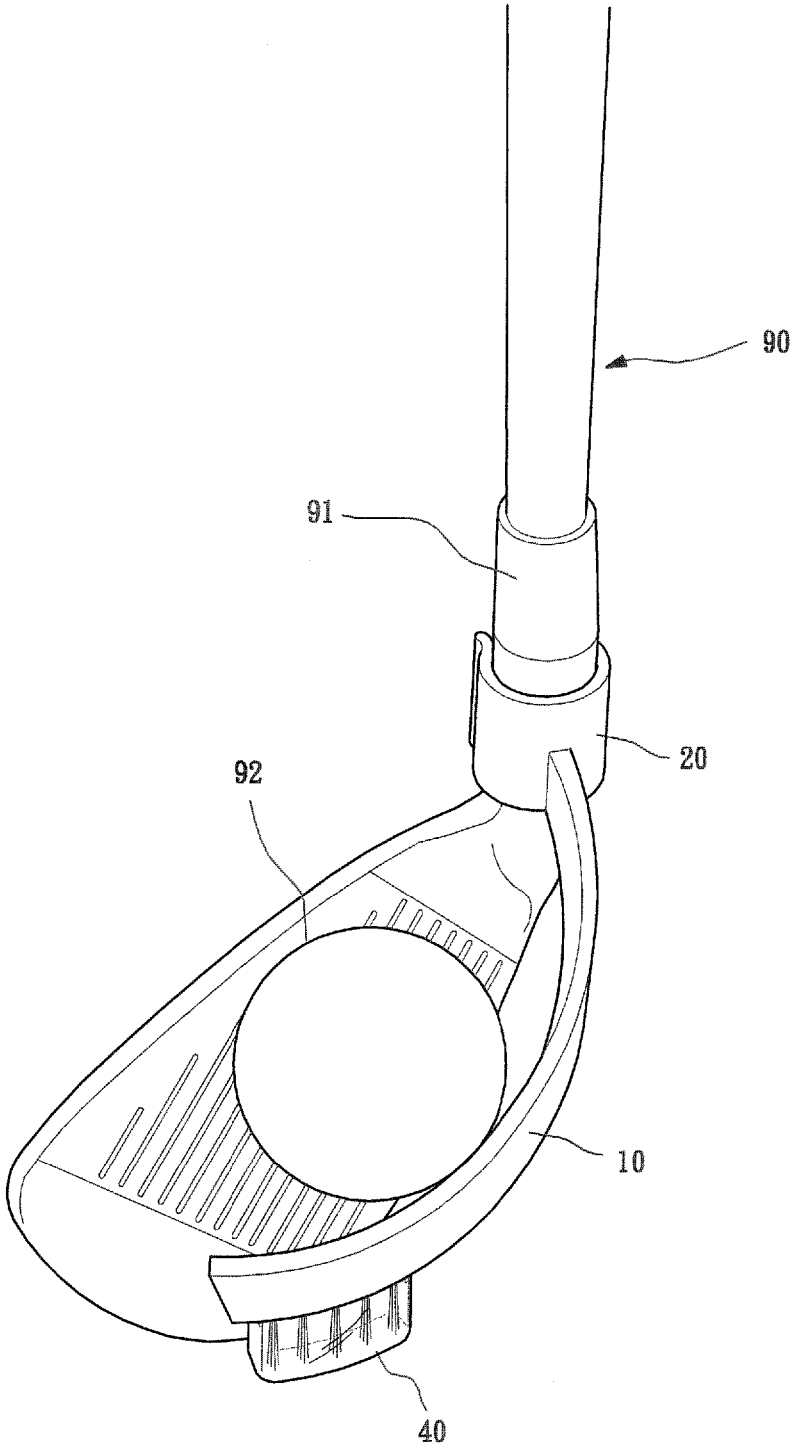
FIG. 5 is a schematic view illustrating the golf ball pick-up device of the present invention forming a frame with the head of the golf club, the frame being usable to pick up a golf ball.

Referring to FIGS. 4 and 5, when a golf player is playing a game and inadvertently hits a ball to a sand trap or water hazard (a sand trap being illustrated in FIG. 4), where hands may not reach for picking up the ball, the player may stretch the golf club 90 to the location of the ball and use the frame formed by the body 10 and the head 92 of the club 90 to pick up the ball. The opening formed in the bottom of the frame formed by the body 10 and the head 92 of the club 90 allows sands or water to flow out of the frame when the frame is used to pick up a ball in a sand trap or a water hazard, so that no sand or water may be kept inside the frame.

Figure 6:
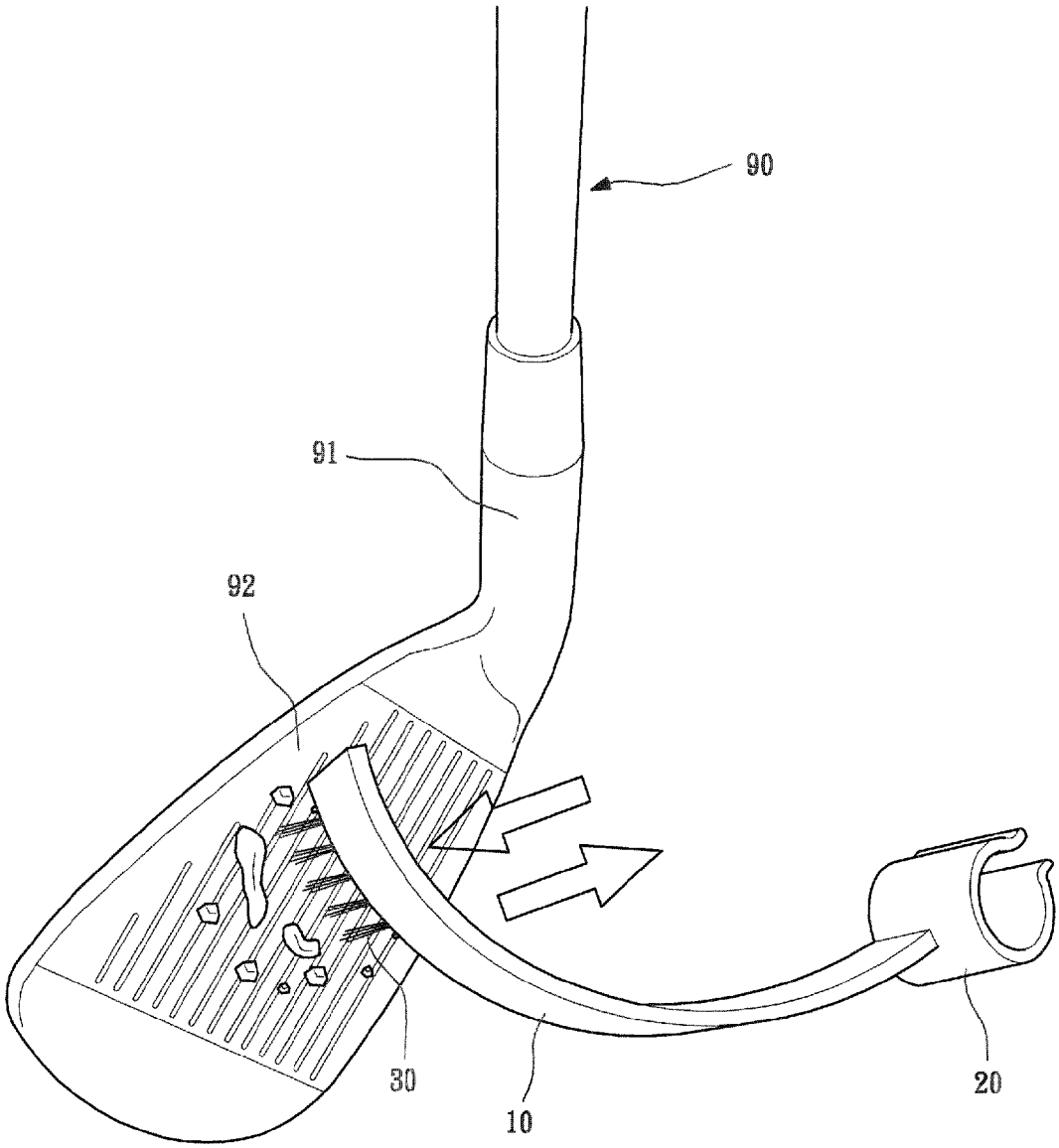
FIG. 6 is a schematic view illustrating using a brush formed in the golf ball pick-up device of the present invention to sweep off mud from the head of the golf club.

Referring to FIG. 6, when a golf player swings a golf club 90 to hit a ball, mud or soil or other debris may get attached to the head 92 due to partial collision of the head 92 with the earth. In this case, the brush 30 can be used to sweep off the mud or dirt attached to the head 92 to provide a cleaning operation for making the club ready for next swing.

Figure 7:
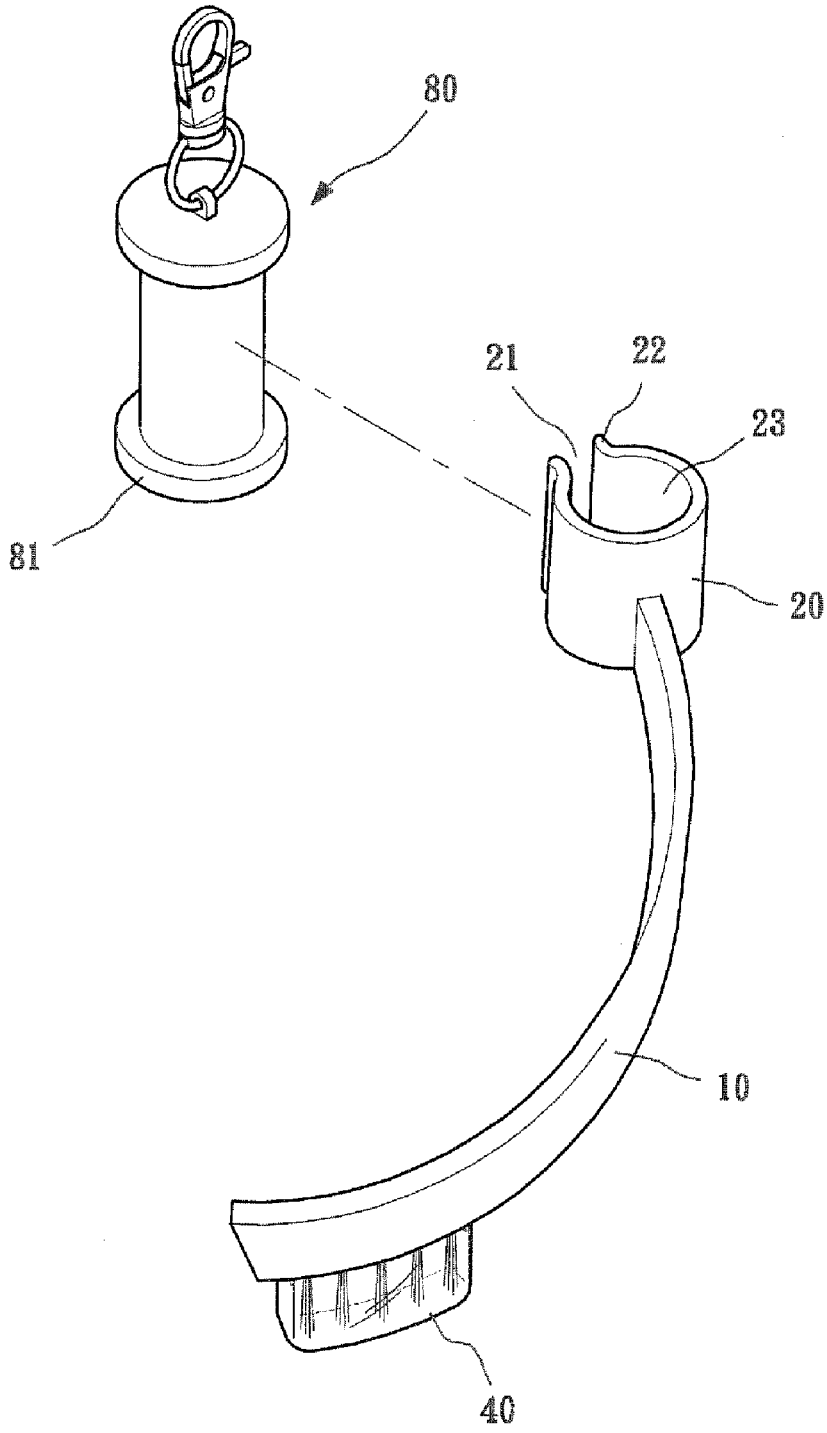
FIG. 7 is a perspective view illustrating mounting the golf ball pick-up device of the present invention to a key ring.

Referring to FIG. 7, the golf ball pick-up device of the present invention can be alternatively mounted to a key ring or buckle 80 to allow a user to carry it on the waist for easy carrying and use. The coupling between the key ring 80 and the golf ball pick-up device of the present invention is done by providing the key ring 80 with a retention seat 81 that has a diameter-reduced central body and expanded top and bottom flanges, making the cross-section of the retention seat 81 an I-shape, and fitting the receiving space 23 of the 20 over the diameter-reduced central body of the retention seat 81. The top and bottom flanges that have outside diameters greater than the central body of the retention seat 81 can effectively prevent the clamping section 20 from separation from the retention seat 81.

Figure 8:
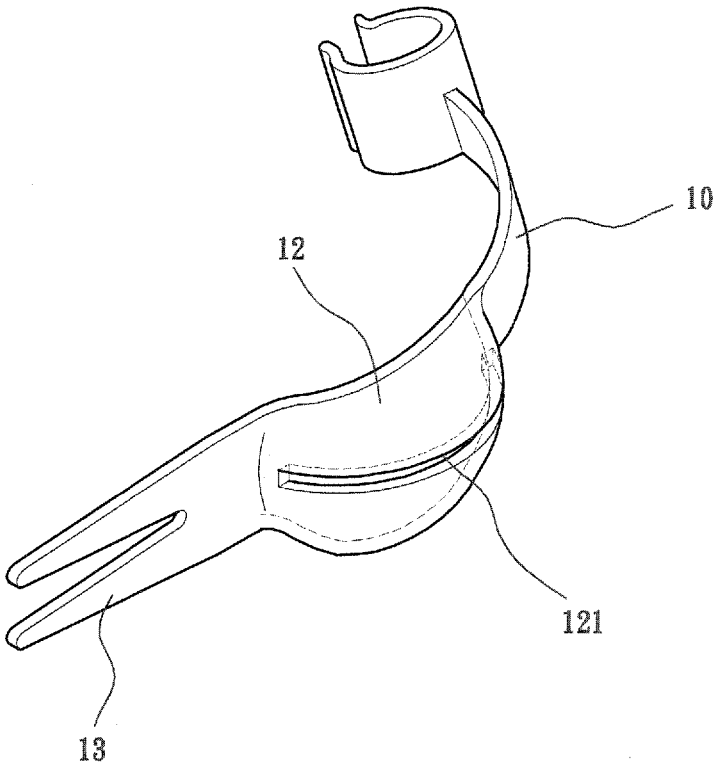
FIG. 8 is a perspective view showing an alternative structure of a body of the device according to the present invention.

Referring to FIG. 8, in an alternative structure of the body 10 according to the present invention, the brush 30 is omitted and the body 10 comprises a curvedly recessed section 12 and a green fork 13 formed on an end thereof. The curvedly recessed section 12 is set to oppose the surface of a golf ball and forms a slot 121. The green fork 13 can be used to repair any recess formed on the green lawn or soil caused by ball hitting. This is because according to the general principle of golf playing, repairing the recess formed on the green by a player is the obligation of the players and is to show respects to other players.

Figure 9:
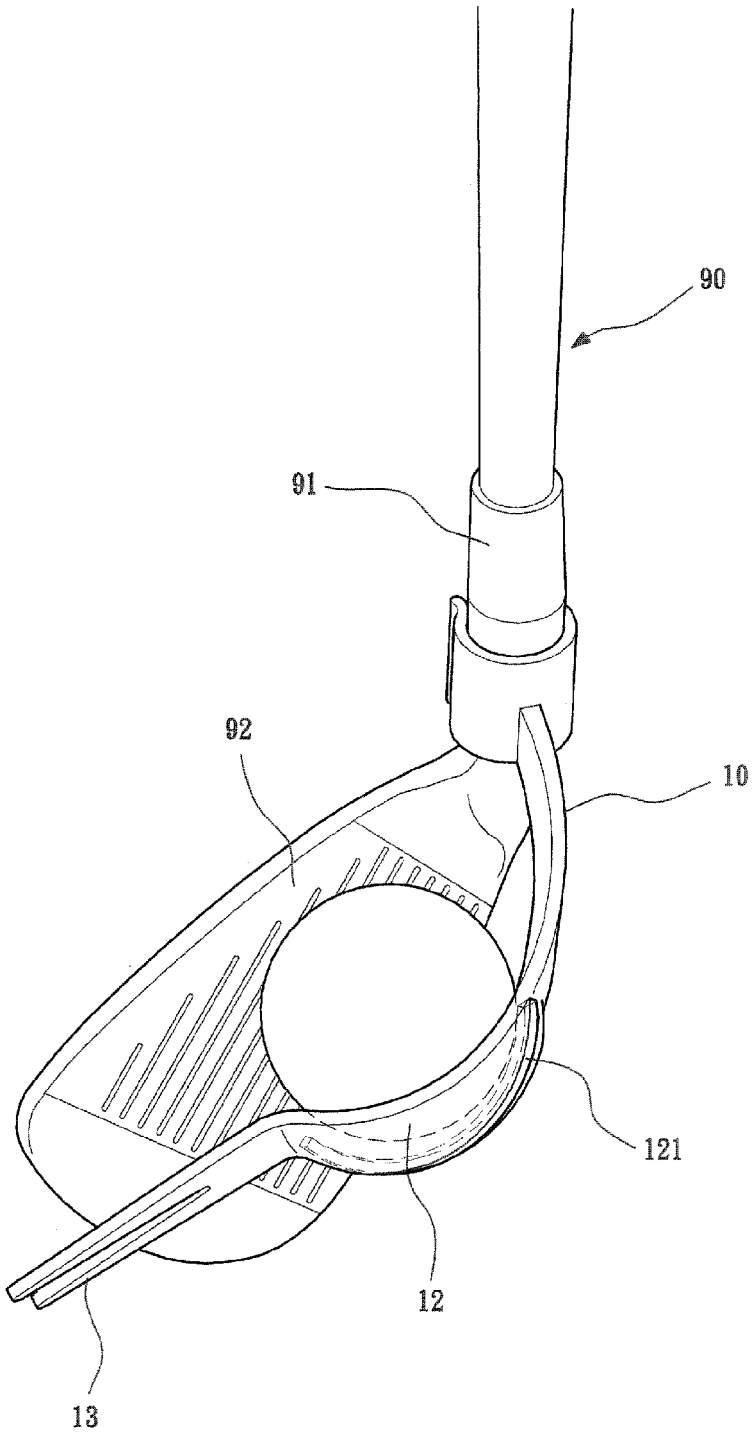
FIG. 9 is a perspective view illustrating the body of the alternative structure of the device according to the present invention mounted to a golf club.

Referring to FIG. 9, said alternative structure of the body 10 is also mountable to a golf club 90 so that the curvedly recessed section 12 and the club head 92 form therebetween a space for accommodating a golf ball that is picked up by using the present invention and thus the golf ball can be stably held.

Figure 10:
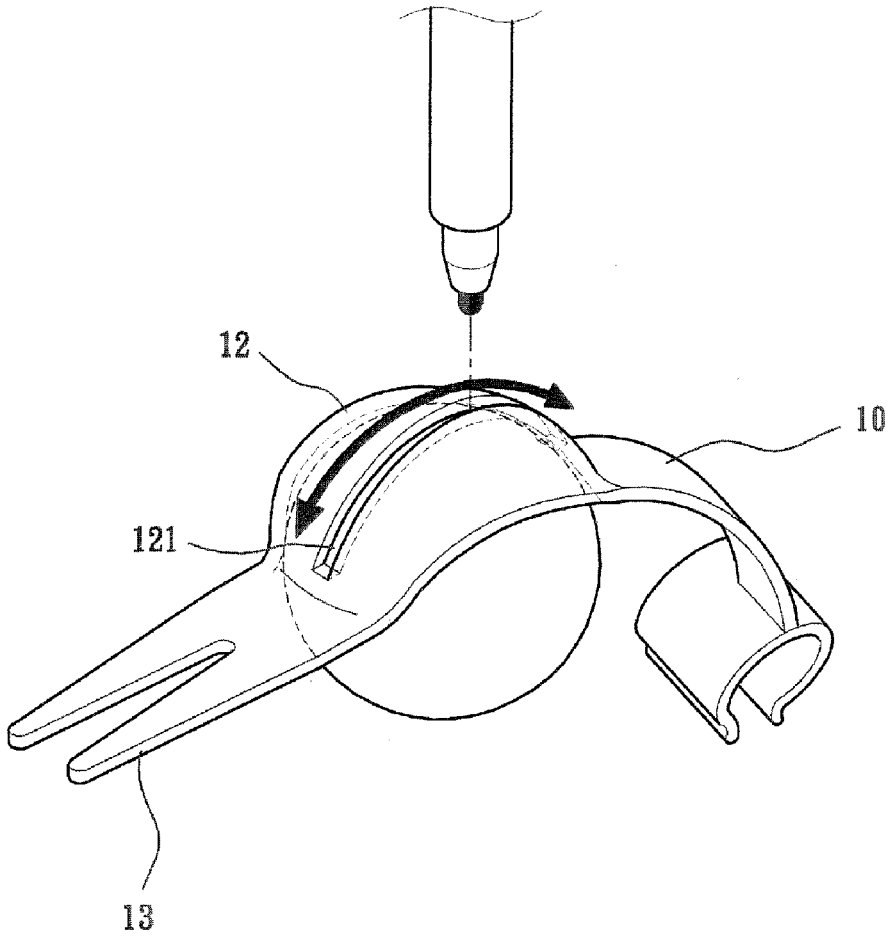
FIG. 10 is a perspective view illustrating a use of the body of the alternative structure of the device according to the present invention.

Referring to FIG. 10, the curvedly recessed section 12 can be positioned against the surface of a golf ball and a user may hold a marking pen with a hand to draw a mark on the golf ball through the slot 121. The mark can be used as a reference for the user to put the golf ball into a hole in the green.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A golf ball pick-up device, comprising a body that is adapted to form a frame with a head of a golf club, the body having an end forming a clamping section that defines an internal receiving space, the clamping section forming a sideway opening in communication with the receiving space, the clamping section having two opposing end edges that delimit the opening, each end edge forming a lead-in flange that provides a guiding-in function, the clamping section being made of plastics to allow the opening to be resiliently expanded, the clamping section having a C-shape, the body having a curved shape, the body having an end forming a fork, wherein the clamping section uses the opening to lead a shaft of the golf club into the receiving space so as to have the clamping section fit over the shaft of the golf club, the frame formed by the body and the head of the golf club has top and bottom openings, of which the top opening is wider than a diameter of a golf ball, while the bottom opening is narrower than the diameter of the golf ball in order to realize the function of picking up a golf ball by holding the golf ball between the body and the head of the golf club, whereby a user is allowed to pick up a ball with the frame formed by the body and the head of the golf club.

2. The golf ball pick-up device according to claim 1, wherein the clamping section is mountable to a key ring and wherein the key ring comprises a retention seat having an I-shaped cross-section composed of a diameter-reduced central body and diameter-expanded top and bottom flanges, the clamping section being fit over and retained on the diameter-reduced central body by the diameter-expanded top and bottom flanges whereby the clamping section is securely retained on the key ring and is prevented from separation therefrom by the top and bottom flanges of the key ring.

3. The golf ball pick-up device according to claim 1, wherein the body forms a curvedly recessed section, a slot being formed in the curvedly recessed section.

* * * * *